US011641900B2

(12) United States Patent
Smith

(10) Patent No.: US 11,641,900 B2
(45) Date of Patent: May 9, 2023

(54) METHODS OF ATTACHING AND REMOVING A HAIR EXTENSION

(71) Applicant: Shantalle Smith, Houston, TX (US)

(72) Inventor: Shantalle Smith, Houston, TX (US)

(73) Assignee: Shantalle J. Smith, Houston, TX (US)

( * ) Notice: Subject to any disclaimer, the term of this patent is extended or adjusted under 35 U.S.C. 154(b) by 128 days.

(21) Appl. No.: 17/242,841

(22) Filed: Apr. 28, 2021

(65) Prior Publication Data

US 2022/0132964 A1 May 5, 2022

Related U.S. Application Data

(60) Provisional application No. 63/109,997, filed on Nov. 5, 2020.

(51) Int. Cl.
*A41G 5/00* (2006.01)

(52) U.S. Cl.
CPC ..... *A41G 5/006* (2013.01); *A41G 5/0046* (2013.01); *A41G 5/0086* (2013.01)

(58) Field of Classification Search
CPC ..... A41G 5/00; A41G 5/0013; A41G 5/002; A41G 5/0046; A41G 5/004; A41G 5/0053; A41G 5/006; A41G 5/0086
See application file for complete search history.

(56) References Cited

U.S. PATENT DOCUMENTS

| | | | |
|---|---|---|---|
| 2,621,663 | A | 12/1952 | Jenkins |
| 2,865,380 | A | 12/1958 | Mitchell |
| 3,280,826 | A | 10/1966 | Jenkins |
| 3,295,534 | A | 1/1967 | Dorkin |
| 4,372,330 | A | 2/1983 | Nelson |
| 4,830,029 | A | 5/1989 | Bird |
| 4,966,173 | A | 10/1990 | Russell |
| 5,121,761 | A | 6/1992 | Meister |
| 5,357,986 | A | 10/1994 | Hargrett |
| 5,551,452 | A | 9/1996 | Barlow |
| 5,575,298 | A | 11/1996 | Hinton |
| 5,740,819 | A | 4/1998 | Hicks |
| 5,752,530 | A | 5/1998 | Traintinger |

(Continued)

FOREIGN PATENT DOCUMENTS

| | | | |
|---|---|---|---|
| KR | 101533909 | B1 | 4/2015 |
| KR | 200487901 | Y1 | 11/2018 |

OTHER PUBLICATIONS

6 Different Knot Methods YouTube video Method 5; Double Loop Through (https://www.youtube.com/watch?v=DcwKSXVhwJU). (Year: 2019).*

(Continued)

*Primary Examiner* — Rachel R Steitz

(57) ABSTRACT

A weave may be created by attaching multiple, unwefted hair extensions to a series of braided rows of a person's natural hair using the strands of unwefted hair extensions to secure such hair extensions, by looping and knotting the hair extensions, to the braided rows of the person's natural hair. The method advantageously secures the hair extensions to the person's natural hair without using harmful chemicals or damaging the person's hair or scalp and such that the hair extensions may appear to be the person's natural hair. The hair extensions may be removed from the person's natural hair without cutting or damaging the person's natural hair.

17 Claims, 11 Drawing Sheets

(56) References Cited

U.S. PATENT DOCUMENTS

| | | | | |
|---|---|---|---|---|
| 5,868,145 | A | 2/1999 | Spann | |
| 5,881,737 | A | 3/1999 | Nelson | |
| 6,019,107 | A | 2/2000 | Overmyer et al. | |
| 6,135,122 | A | 10/2000 | Campbell et al. | |
| 6,405,736 | B2 | 6/2002 | Townsend | |
| 6,446,636 | B1 | 9/2002 | Vittallo | |
| 6,832,614 | B2 | 12/2004 | Frazier | |
| 7,753,057 | B2 | 4/2010 | Kallabat et al. | |
| 2003/0226571 | A1* | 12/2003 | Rahman | A41G 3/00 132/201 |
| 2006/0060212 | A1 | 3/2006 | Rodriguez | |
| 2006/0065280 | A1 | 3/2006 | Cheung | |
| 2008/0295856 | A1 | 12/2008 | Kallabat | |
| 2009/0071492 | A1 | 3/2009 | Oh | |
| 2009/0120451 | A1 | 5/2009 | Kenna | |
| 2011/0220136 | A1 | 9/2011 | Kang | |
| 2011/0226274 | A1* | 9/2011 | Turner | A41G 5/006 132/201 |
| 2013/0255707 | A1 | 10/2013 | Oh | |
| 2018/0055185 | A1 | 3/2018 | Spann-Myers | |
| 2018/0103706 | A1* | 4/2018 | Lee | A41G 5/006 |

OTHER PUBLICATIONS

How to Take Down/Remove Crochet Braids, TastePink (https://www.youtube.com/watch?v=Z_GqaZC_7Dw). May 24, 2015 (Year: 2015).*

* cited by examiner

METHODS OF ATTACHING AND REMOVING A HAIR EXTENSION

PRIORITY CLAIM

This application claims priority to and the benefit of the filing date of U.S. Provisional Application Ser. No. 63/109,997, filed Nov. 5, 2020.

FIELD OF THE DISCLOSURE

The instant disclosure relates to hair extensions. More specifically, portions of this disclosure relate to methods for attaching hair extensions to and removing hair extensions from a person's natural hair.

BACKGROUND

The hair services industry has produced several methods for attaching real or synthetic hair to the scalp or natural hair of a person. The attached hair is usually referred to as a hair extension and the hair style created by these methods is often referred to as a weave. A weave is created using various, and sometimes dangerous, attachment methods, such as using wefted hair extensions, threads, adhesives such as glues, clamps, clips, caps, chemicals, metal rings and links, and even surgical methods. Such methods are harmful to the person's natural hair and scalp, do not adequately secure the hair extensions, and/or appear unnatural. For example, some of these methods use adhesives to infuse hair extensions directly to the person's natural hair or scalp that risks damaging the person's hair and/or scalp, for example, when the extensions are removed. Other methods fail to adequately secure the hair extensions to the person's natural hair or scalp such that the hair extensions fall out or become loose when manipulating (e.g., styling) the hair extensions or even during normal life activities such as sleeping or exercising. This problem arises often when the natural hair of the person is silky, straight, and/or thin. Still other methods require bulky attachments near the base of the person's natural hair or allow the natural hair of the person to be seen through or among the extensions (sometimes referred to as "leave outs") such that another person might easily identify the hair extensions as not being part of the person's natural hair.

Shortcomings mentioned here are only representative and are included to highlight problems that the inventors have identified with respect to existing methods of attaching hair extensions. Aspects of the methods described below may address some or all of the shortcomings as well as others known in the art. Aspects of the improved methods described below may present other benefits than, and be used in other applications than, those described above.

SUMMARY

As described more fully below, a weave may be created by attaching multiple, unwefted hair extensions to a series of braided rows of a person's natural hair using the strands of unwefted hair extensions to secure such hair extensions, by looping and knotting the hair extensions, to the braided rows of the person's natural hair. Such methods advantageously secure (e.g., without slippage) the hair extensions to the person's natural hair (even when manipulating the hair extensions by, for example, curling them with heat, styling them, washing them, or combing them, and/or during normal life activities such exercising or swimming) without damaging the person's hair or scalp and such that the hair extensions may appear to be the person's natural hair. The hair extensions may be removed from the person's natural hair without cutting or damaging the person's natural hair. The hair extensions may have a variety of curl patterns, lengths (e.g., between 12 and 24 inches), and weights (e.g., 0.5 to 1 gram or more).

In addition to the advantages just stated, the attachment methods described herein include the ability to increase thickness and/or volume of the hair extensions without adding undue stress, tension or weight to the person's natural hair (i.e., the style is lightweight). Also, the attachment methods described use about two times less hair (via extensions) than is typically needed to create a weave and, in addition to not having leave outs, do not create bulky or noticeable hair extension roots (i.e., at the attachment location). After creating a weave using the attachment methods described herein, the person's natural hair and scalp is still exposed to the air (i.e., it can "breath"), the person may use oils on their scalp to stimulate and retain hair growth, and the person can freely style the hair extensions without pulling out their natural hair or loosening attachment of the hair extensions. For example, using the attachment methods described herein, a weave may last between 6 and 18 weeks or longer before any correction is needed.

According to one embodiment, a hair extension may be attached to a person's natural hair by braiding the hair of a person into a row on the head of the person to form a braided row; and then, attaching an unwefted hair extension of multiple hair strands to the braided row. The braided row may be secured using a fastener, such as a colored rubber band. The hair extension may have a first end, a second end, and a midpoint between the first end and the second end and attaching the unwefted hair extension to the braided row may comprise first passing the midpoint under the braided row at a location that is between the braided row and the head of the person without passing the first end and the second end under the braided row, such that a first portion of the unwefted hair extension is formed between the location and the first end and a second portion of the unwefted hair extension is formed between the location and the second end; second, axially rotating the midpoint about the location to create a loop in the unwefted hair extension; third, passing the first end through the loop and tightening the loop against the braided row at the location to create a first knot; and fourth, securing the loop against the braided row at the location by tying a second knot (such as a slip knot) adjacent to the loop with some of the strands (e.g., a minority of the strands) of the first portion and some of the strands (e.g., a minority of the strands) of the second portion.

In some embodiments, the strands of the first portion and the strands of the second portion (except in some instances the minority strands) are positioned on the person's head such that they are covering the person's hair. In some embodiments, creating the loop includes axially rotating the midpoint about the location multiple times. In some embodiments, the loop is secured against the braided row by tying more than one second knot adjacent to the loop with some of the strands of the first portion and some of the strands of the second portion. Before securing the loop against the braided row, the strands of the first portion may be wrapped one or more times around some of the strands of the second portion. The loop may be further secured by tying a third knot against the loop using some of the strands of the first portion and the second portion. The first portion and the second portion may then be positioned such that they are covering the person's hair. In some embodiments, the unwefted hair extension is at least in part attached to the braided row using a crochet tool, for example, by coupling the unwefted hair extension to a crochet tool and pulling the midpoint of the unwefted hair extension under the braided row using the crochet needle. In some embodiments, the unwefted hair extension may be attached to the braided row without using any adhesive, tape, heat, chemicals, clips, caps, wefts, or thread.

In some embodiments, one of more of the methods of attaching an unwefted hair extension to a braided row just described may be used to attach additional unwefted hair extensions to the braided row and/or to additional braided rows of the person's natural hair, for example, until the weave is complete and the unwefted hair extensions completely cover the person's natural hair. In some embodiments, the unwefted hair extension may have a midpoint that is equidistant from its ends and both ends of the hair extension may be positioned over the same side of the braided row on the person's head. In some embodiments, the unwefted hair extension may have a midpoint that is closer to one of its ends than the other and both ends of the hair extension may be positioned over the same side of the braided row on the person's head.

The unwefted hair extension(s) just described may be removed from the braided row(s) without cutting the hair of the person or using chemicals and may include cutting the unwefted hair extension(s) near the attachment location of such unwefted hair extension(s). In some embodiments, the unwefted hair extension(s) may be removed by first removing a fastener, such as a colored rubber band, from the braided row to which the hair extension(s) are attached, and slipping the hair extensions from the braided row as the braided row is unbraided.

As used herein, the term "coupled" means connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially parallel includes parallel), as understood by a person of ordinary skill in the art.

The phrase "and/or" means "and" or "or". To illustrate, A, B, and/or C includes: A alone, B alone, C alone, a combination of A and B, a combination of A and C, a combination of B and C, or a combination of A, B, and C. In other words, "and/or" operates as an inclusive or.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus or system that "comprises," "has," or "includes" one or more elements possesses those one or more elements, but is not limited to possessing only those elements. Likewise, a method that "comprises," "has," or "includes," one or more steps possesses those one or more steps, but is not limited to possessing only those one or more steps.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings. Elements within each FIGURE are generally drawn to scale relative to other elements in the same FIGURE.

DETAILED DESCRIPTION

Figure 1B:
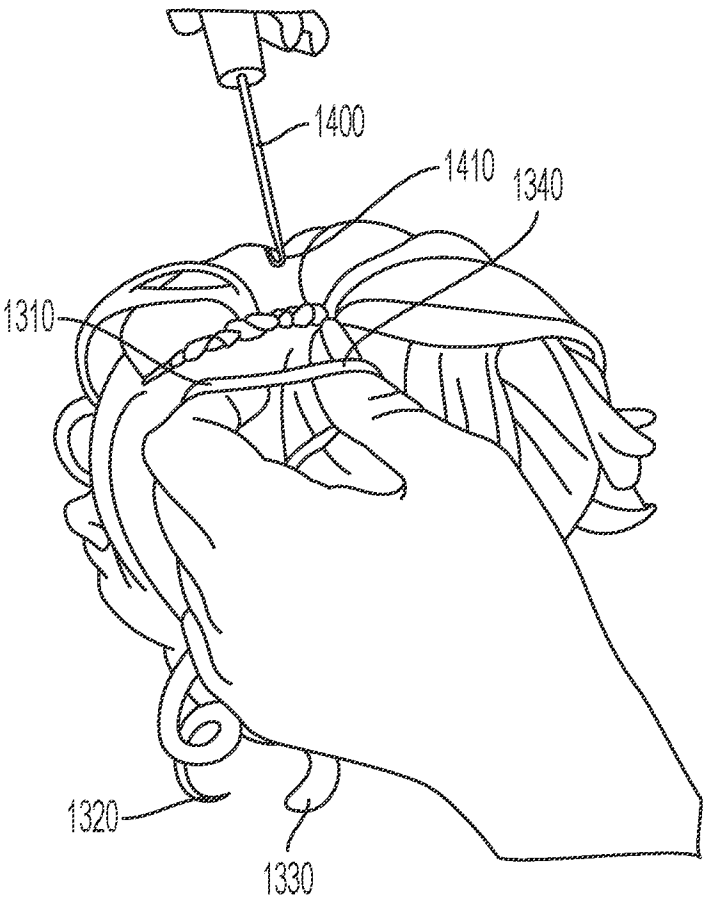
FIGS. 1A through 1T are images of a process for attaching an unwefted hair extension to a person's natural hair according to some embodiments of the disclosure.
Figure 1A:
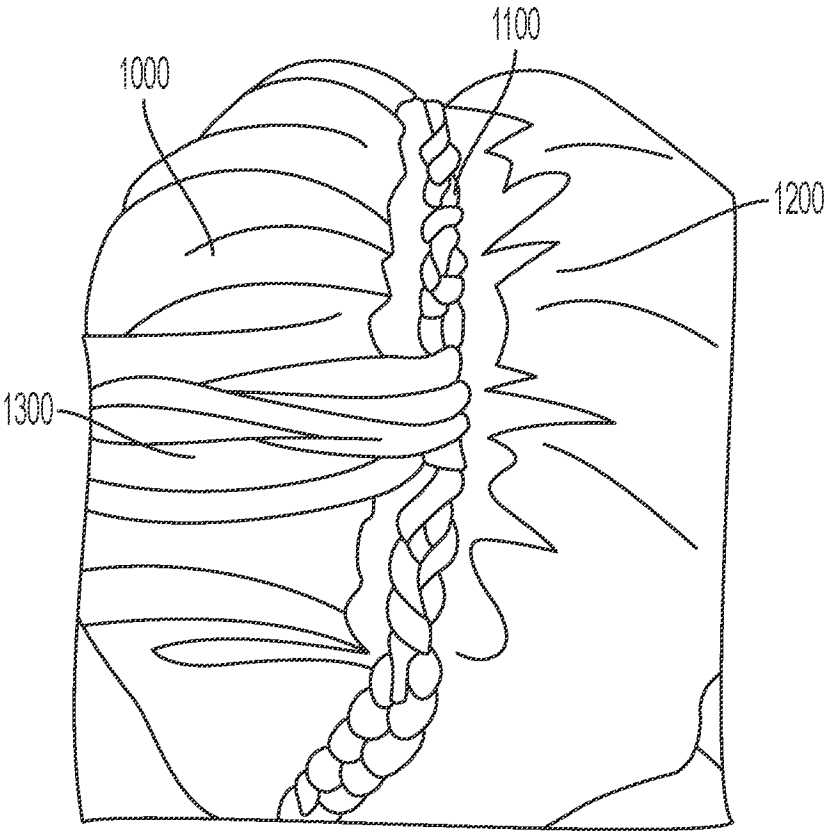
Figure 1D:
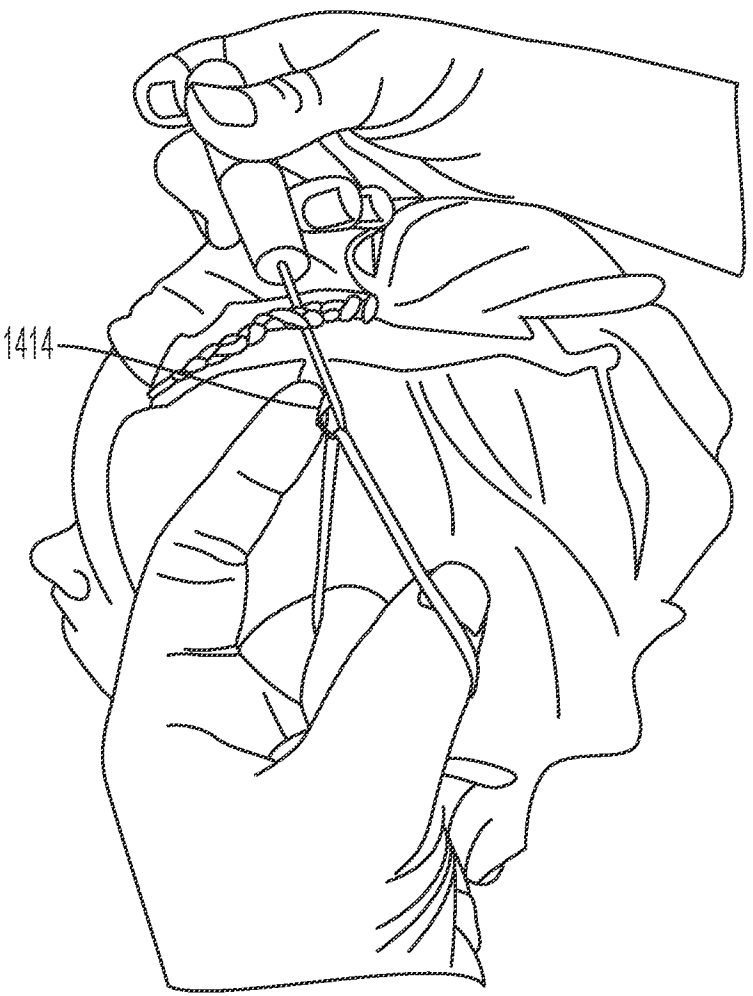
Figure 1C:
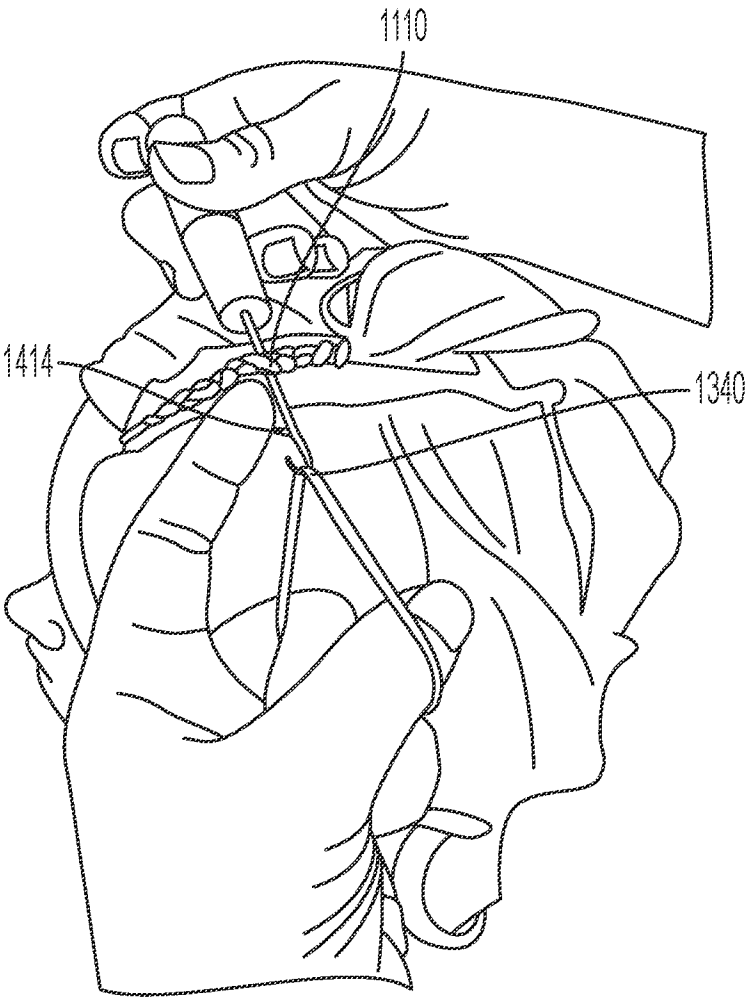
Figure 1F:
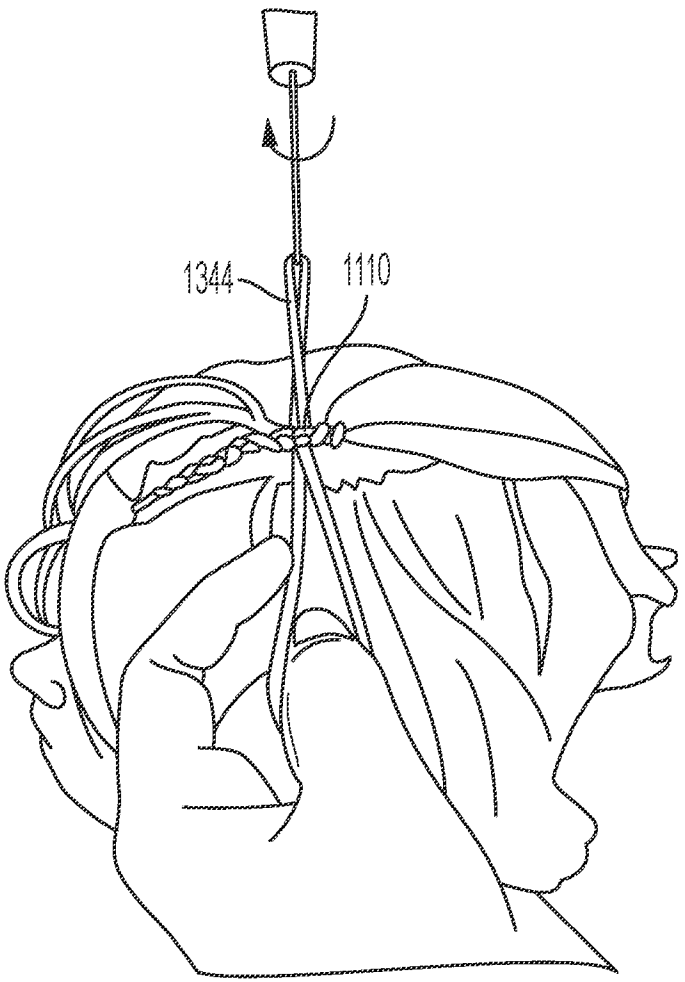
Figure 1E:
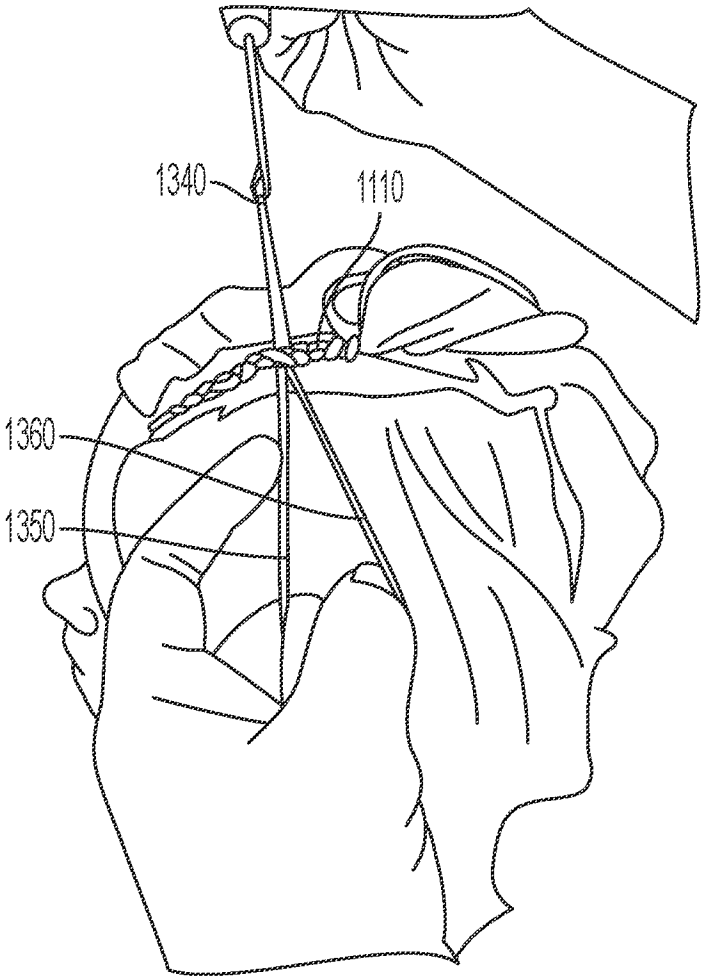
Figure 1H:
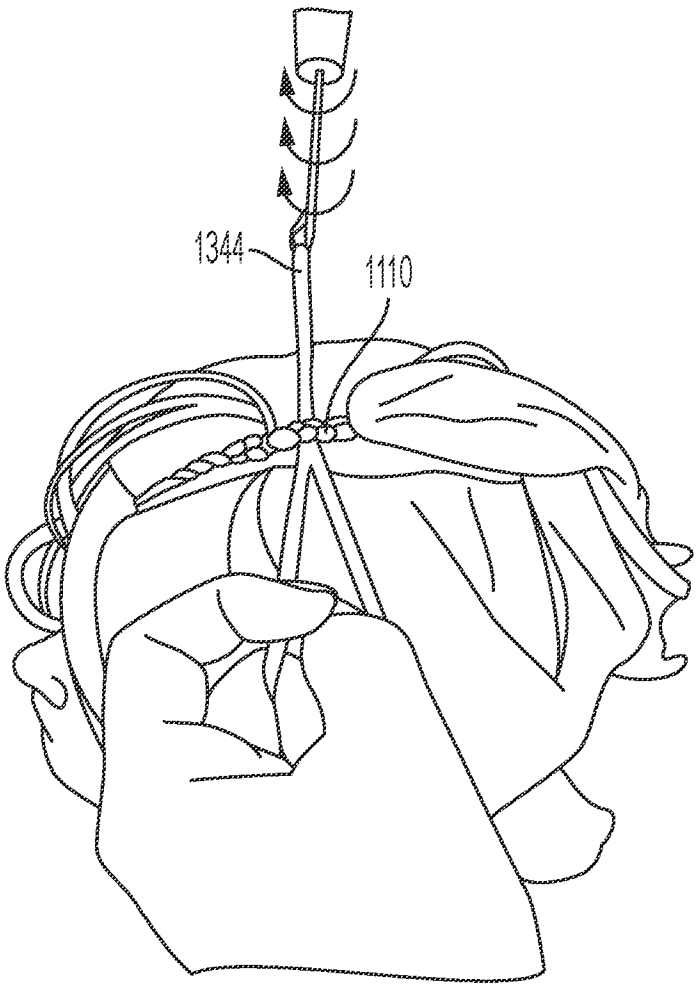
Figure 1G:
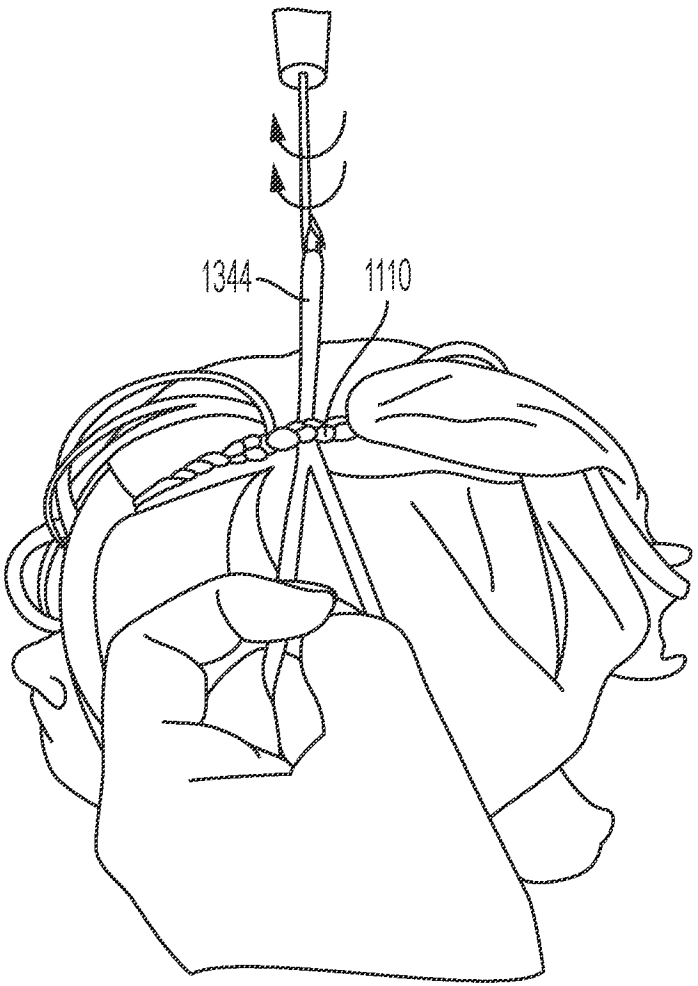
Figure 1J:
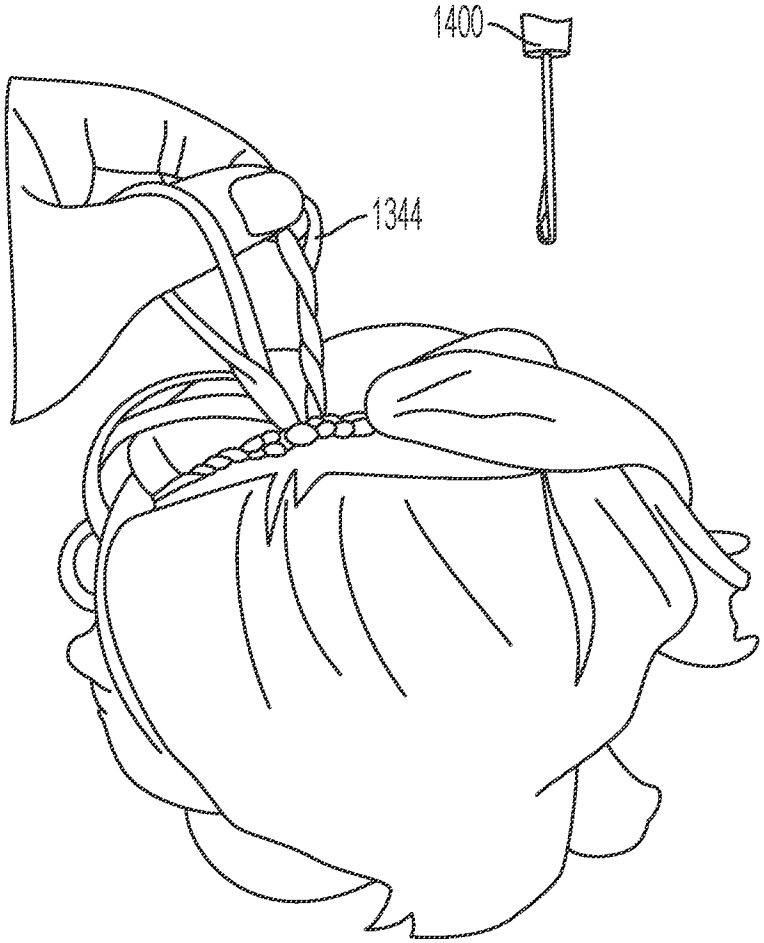
Figure 1I:
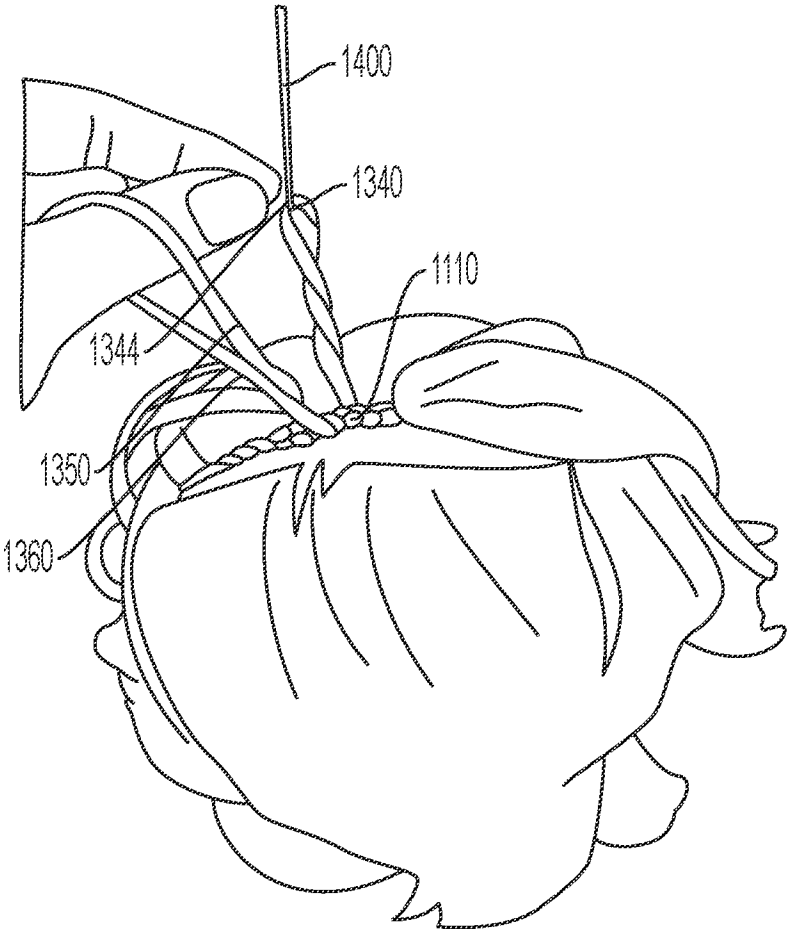
Figure 1L:
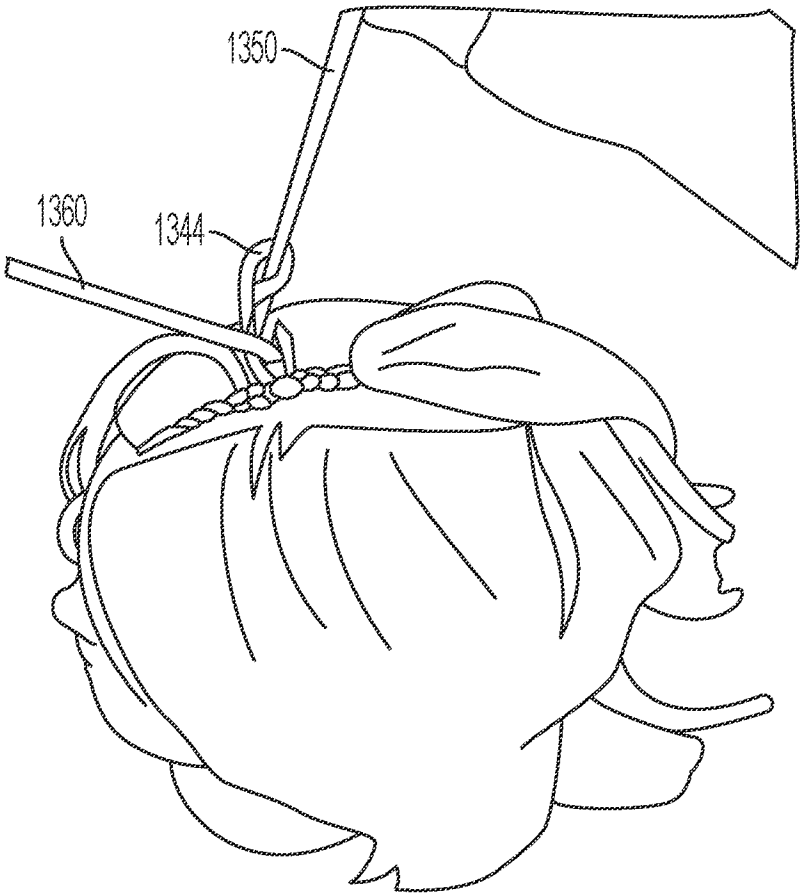
Figure 1K:
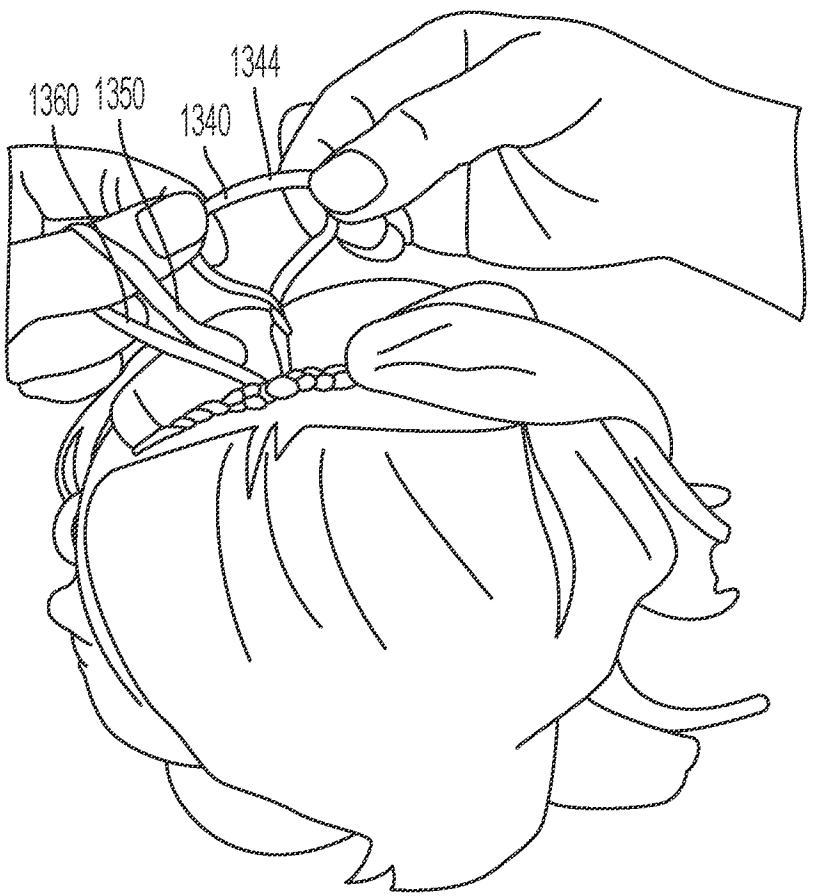
Figure 1N:
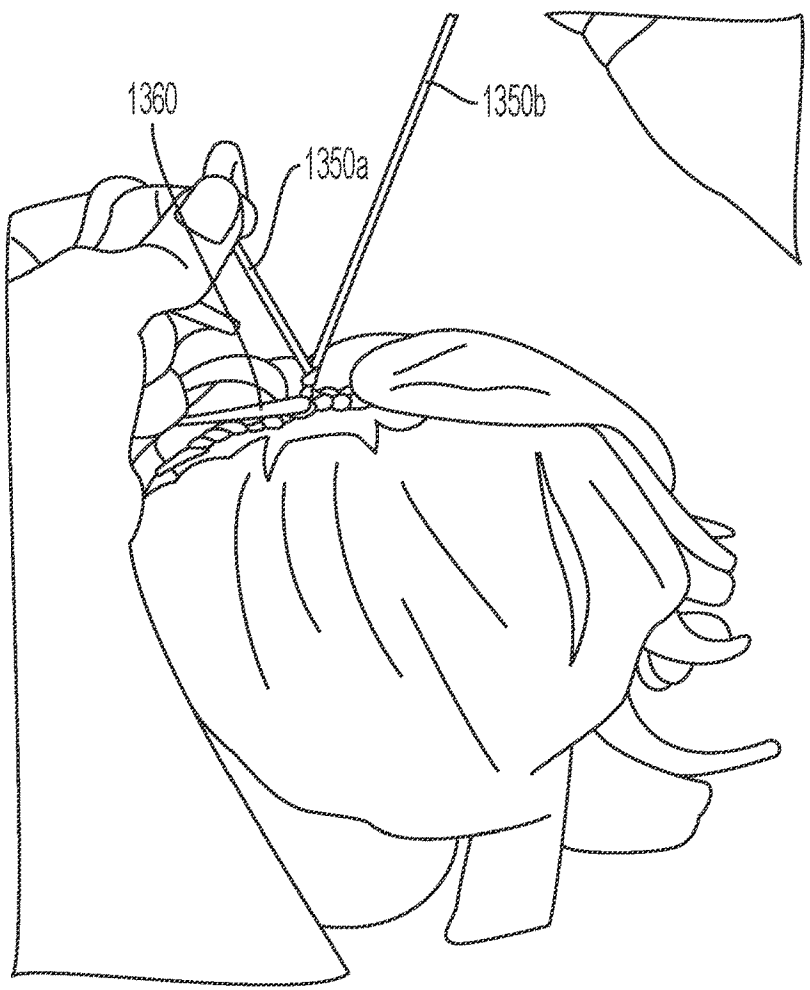
Figure 1M:
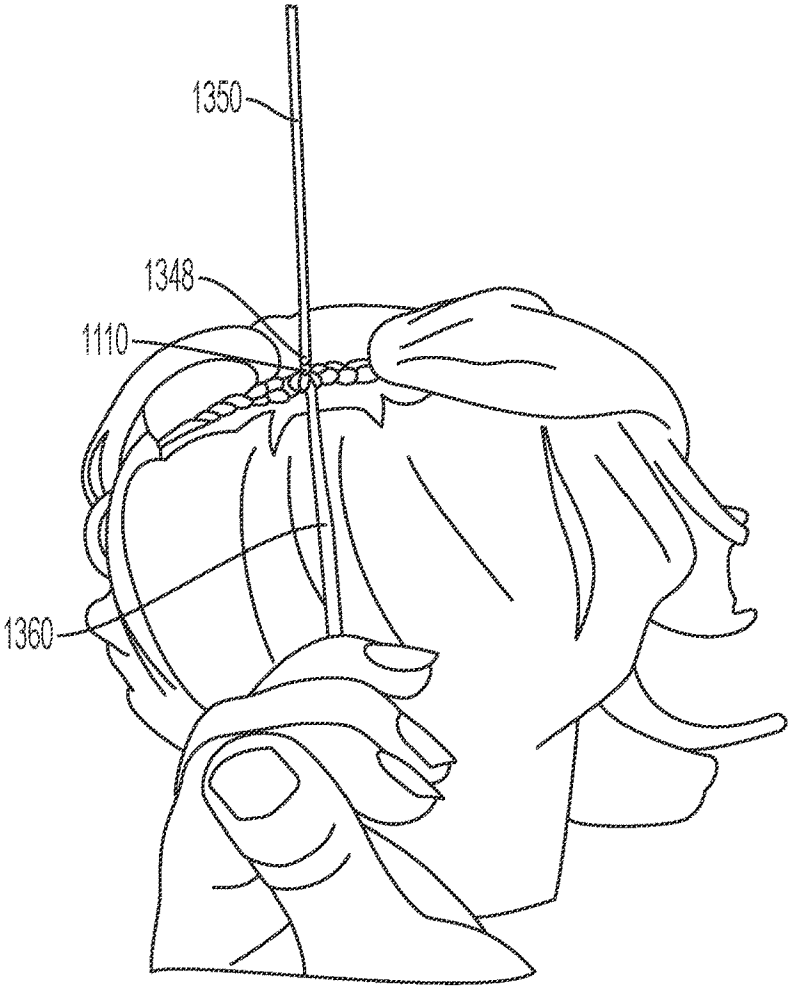
Figure 1P:
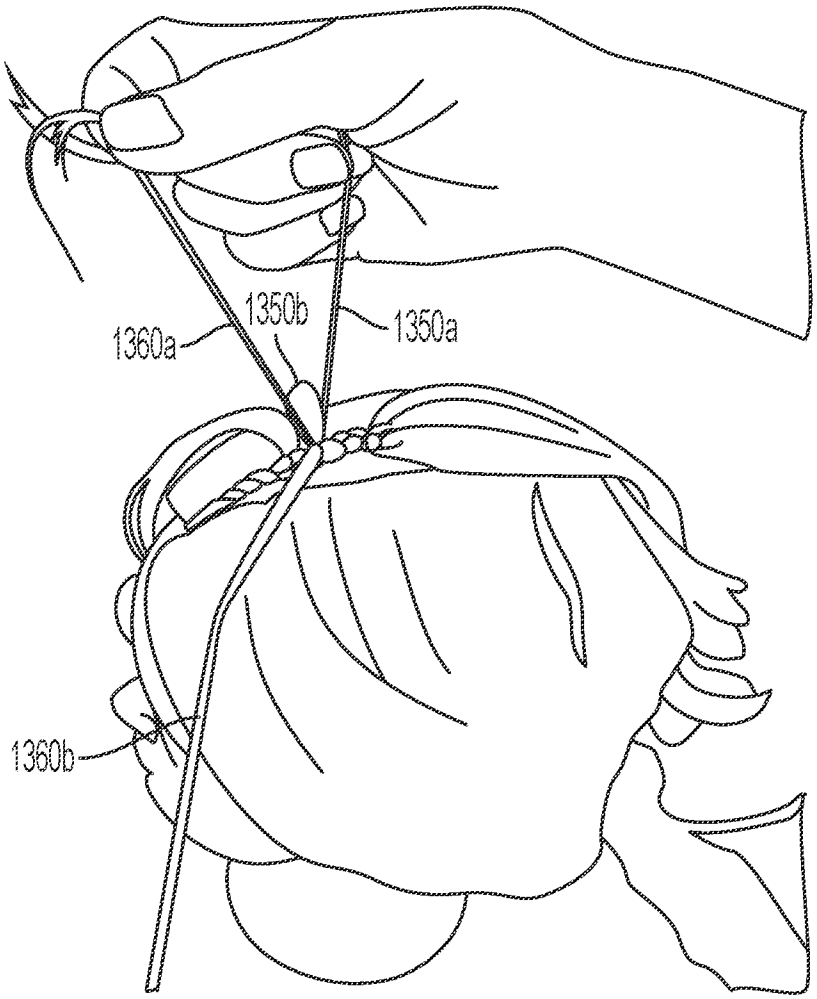
Figure 1O:
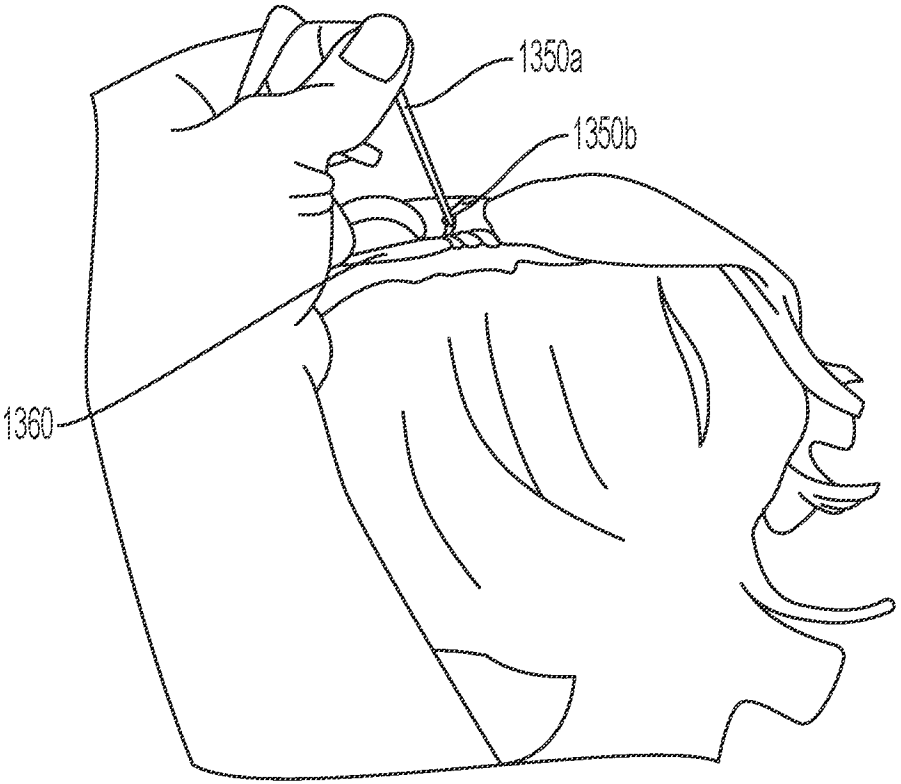
Figure 1R:
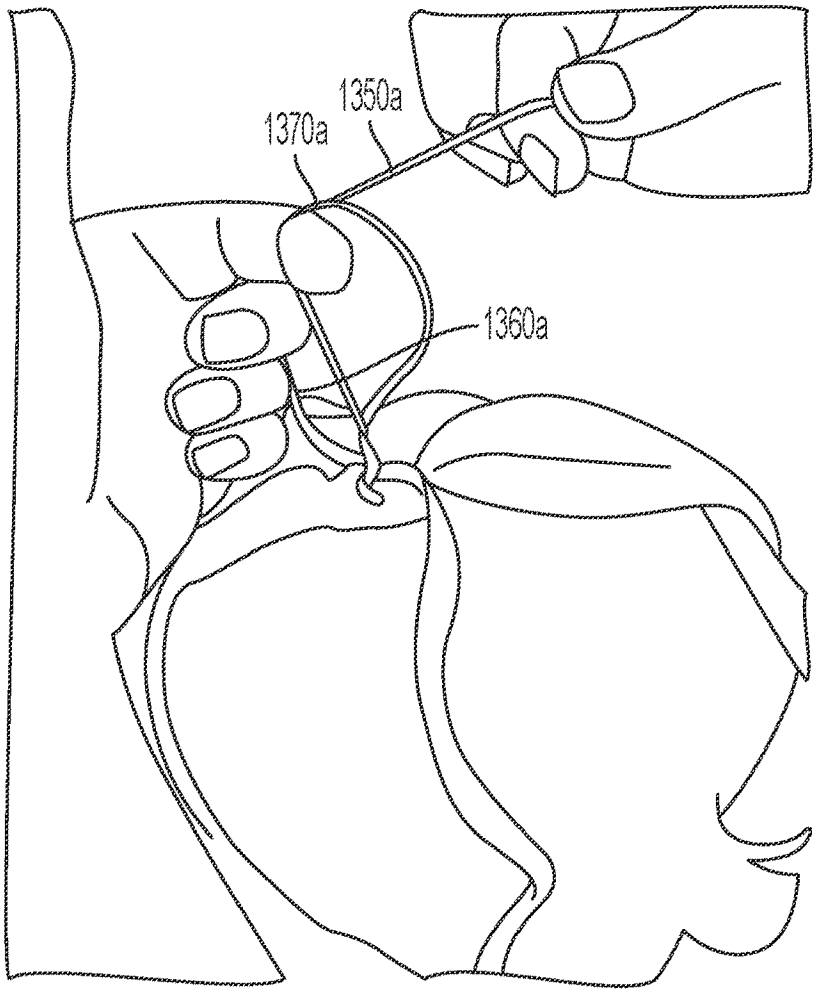
Figure 1Q:
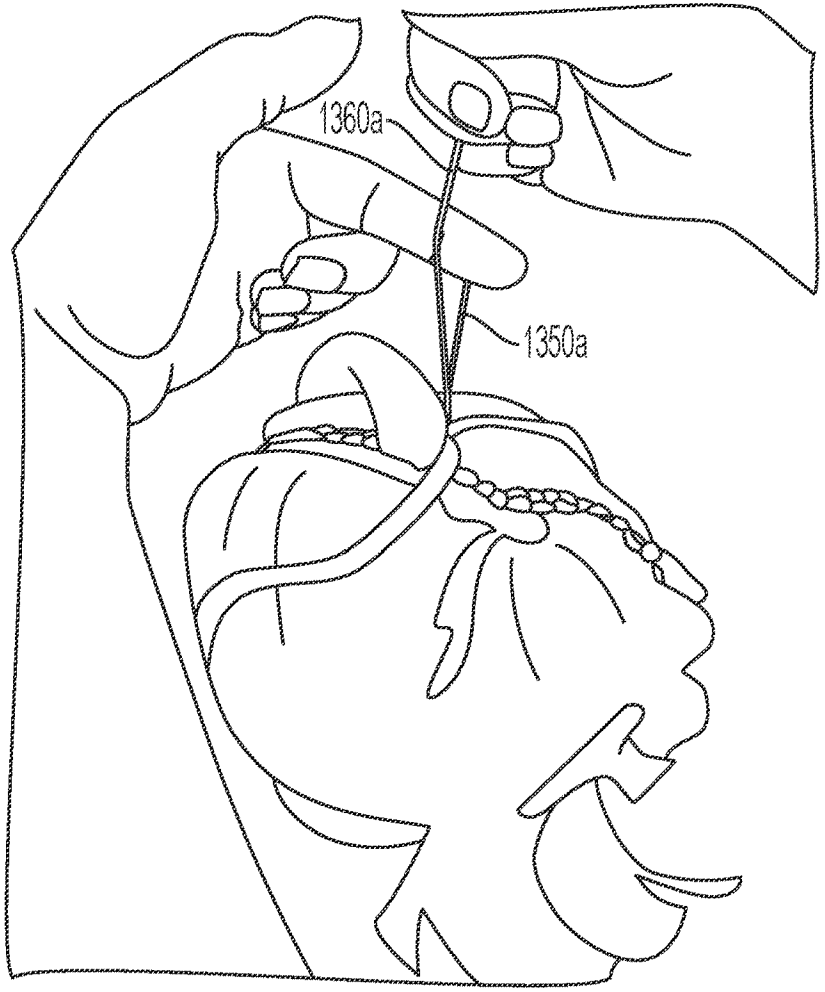
Figure 1T:
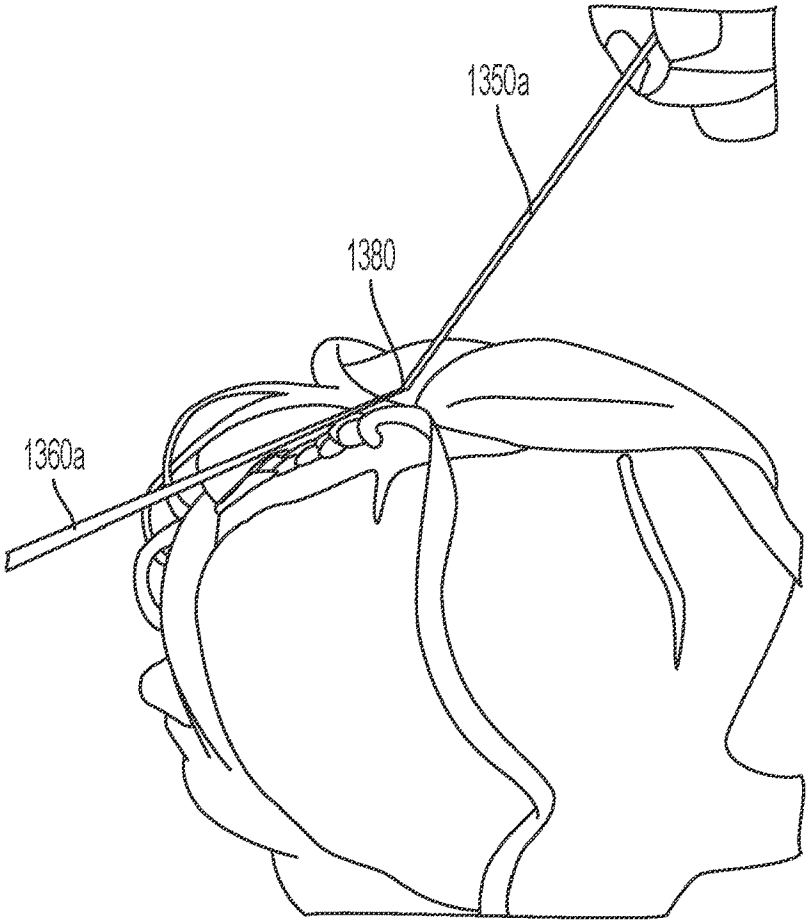
Figure 1S:
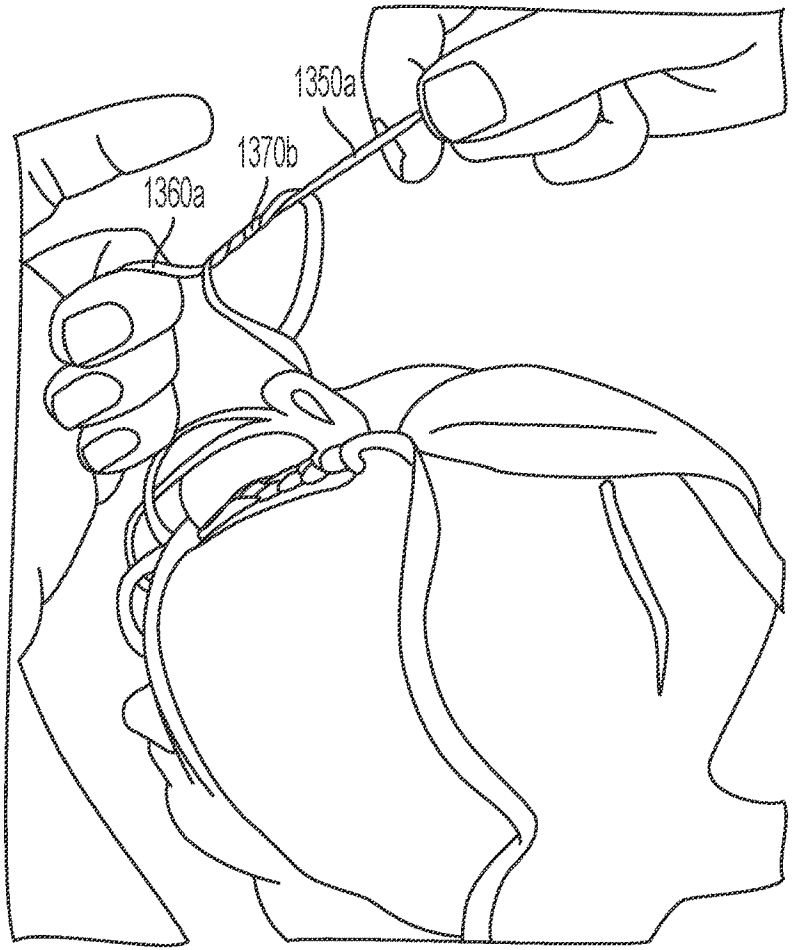

FIGS. 1A-1T depict a method of attaching an unwefted hair extension to a person's natural hair. While FIGS. 1A-1T depict the method performed on human hair attached to a mannequin, the method is the same when performed on the hair of a live person. As such, the mannequin's hair in FIGS. 1A-1T will be referred to throughout this disclosure as "natural hair" and the mannequin will be referred to as a "person."

FIG. 1A depicts a head 1000 having natural hair 1200 that has been braided into a row 1100 close to head 1000. Braided row 1100 is an under-braid sometimes referred to as a "cornrow" but another type of braid may also be employed such as a French braid. Under-braiding lays the braids closer to the person's head, creating a generally flatter foundation than French braids, which is advantageous for, for example, persons with hair of above average thickness. While not shown in FIG. 1A, a fastener, such as a rubber band or elastic, may be used to secure the braid. In some embodiments, the fastener may be colored so that it can be more easily located under the weave and removed when, for example, it is desired to remove the weave (i.e., remove the attached hair extensions). Additionally, frontal braids (not shown) may be included prior to, during, or after attaching the hair extensions. For example, only about 12 frontal braids may be used (e.g., about 2.5 to 3 packs of hair extensions and/or about 200-300 grams) in order to create a full, but not heavy hair style. Returning to FIG. 1A, multiple, unwefted hair extensions 1300 have been attached to braided row 1100 using the process that is about to be described.

The process begins by obtaining an unwefted hair extension 1310 having a first end 1320, second end 1330 and a midpoint 1340, as shown in FIG. 1B. Unwefted hair extension 1300 is made from natural human hair. However, in other embodiments unwefted hair extension 1310 may be made from synthetic or blended materials or otherwise. A crochet tool 1400 having a hook 1410 or other instrument may be used to facilitate attachment of hair extension 1310 to braided row 1100. As shown in FIG. 1C, crochet tool 1400 is passed between braided row 1100 and head 1000 at an attachment point 1110 and receives the midpoint 1340 of hair extension 1310 in its hook 1410. Hook 1410 may include a latch 1414 that may be moved from an open position (shown in FIG. 1C) configured to receive hair extension 1310 to a closed position (shown in FIG. 1D) configured to prevent the strands of hair extension 1310 from escaping hook 1410, for example, when hair extension is moved with crochet tool 1400 under braided row 1100.

Next, as shown in FIG. 1E, crochet tool 1400 is passed (i.e., pulled) back between braided row 1100 and head 1000 such that the midpoint 1340 of hair extension 1310 passes (i.e., is pulled) between braided row 1100 and head 1000 at attachment point 1110 until midpoint 1340 is on one side of the braided row 1100 and first end 1320 and second end 1330 of hair extension 1100 are on the other side of braided row 1100. As shown in FIG. 1E, this creates a first portion 1350 of hair extension 1310 extending from attachment point 1110 to first end 1320 and a second portion 1360 of hair extension 1310 extending from attachment point 1110 to second end 1330.

Next, as shown in FIG. 1F, the midpoint 1340 of hair extension 1310 is rotated axially about attachment location 1110 to create a first loop 1344 in hair extension 1310 between midpoint 1340 and attachment location 1110. Rotation of midpoint 1340 may be achieved by axially rotating crochet tool 1400. Loop 1344 may be made smaller by continuing axial rotation of midpoint 1340 about attachment location 1110 (e.g., using crochet tool 1400). For example, as shown in FIG. 1G, midpoint 1340 is axially rotated a second time and, as shown in FIG. 1H, midpoint 1340 is axially rotated a third time. Midpoint 1340 may continue to be axially rotated until loop 1340 reaches the desired size. The more times midpoint 1340 is axially rotated about attachment location 1110, the smaller loop 1344 will become and the tighter and more secure the knot 1348 (see FIG. 1M) will become.

Continuing, as shown in FIG. 1I, first portion 1350 may be passed over braided row 1100 (i.e., not between braided row 1100 and head 1000) and, as shown in FIG. 1J, crochet tool 1400 may be decoupled from hair extension 1310 (e.g., by moving latch 1414 into its unlocked position and sliding loop 1344 from hook 1410). As shown in FIG. 1K, loop 1344 may be widened about midpoint 1340 and first portion 1350 passed through loop 1344 such that first end 1320 of hair extension 1310 passes entirely through loop 1344, as shown in FIG. 1L. First portion 1350 is then tightened against attachment point 1110, for example, by pulling on first portion 1350 in a direction away from head 1000 while simultaneously pulling on second portion 1360 in a different direction away from head 1000, such that a knot 1348 is formed at midpoint 1340 of hair extension 1310 about attachment point 1110 of braided row 1100, as shown in FIG. 1M.

In order to further secure hair extension 1310 about braided row 1100, some of the strands of first portion 1350 (e.g., a minority of the strands) and some of the strands of second portion 1360 (e.g., a minority of the strands) may be used form one or more additional knots (e.g., slip knots) in hair extension 1310 at attachment point 1110. As shown in FIG. 1N, first portion 1350 may be divided into two smaller portions 1350*a* and 1350*b*. Portion 1350*a* may comprise a minority of strands of hair of first portion 1350 and portion 1350*b* may comprise a majority of stands of hair of first portion 1350. As shown in FIG. 1O, portion 1350*b* may be positioned over natural hair 1200 of head 1000 to cover a portion of natural hair 1200 in a similar manner that hair extensions 1300 cover natural hair 1200. Preferably, portion 1350*b* covers a portion of natural hair 1200 so that there are no leave outs (i.e., no natural hair 1200 that is visible through portion 1350*b*). Like first portion 1350, second portion 1360 may similarly be divided into two smaller portions 1360*a* and 1360*b*, as shown in FIG. 1P. Portion 1360*a* may comprise a minority of strands of hair of first portion 1360 and portion 1360*b* may comprise a majority of stands of first portion 1360. Portion 1360*b* may be positioned over natural hair 1200 of head 1000 to cover a portion of natural hair 1200 in a similar manner that hair extensions 1300 cover natural hair 1200. Preferably, portion 1360*b* covers a portion of natural hair 1200 so that there are no leave outs (i.e., no natural hair 1200 that is visible through portion 1360*b*).

Turning to FIG. 1Q, portion 1350*a* may then be wrapped around portion 1360*a* to create a twist 1370*a*, as shown in FIG. 1R. Portion 1350*a* may be wrapped additional times around portion 1360*a* to create a thicker and/or tighter twist 1370*b*. The thicker and/or tighter the twist becomes, the more secure and thick will be the knot 1380 (see FIG. 1T). Knot 1380 is formed by pulling twist 1370*a*/1370*b* toward braided row 1100 at attachment point 1110, for example, by pulling portion 1350*a* in a direction away from attachment point 1110 while simultaneously pulling portion 1360*a* in a different direction away from attachment point 1110. Portions 1350*a* and 1360*a* may then be positioned over natural hair 1200 of head 1000 to cover a portion of natural hair 1200 in a similar manner that portions 1350*b* and 1360*b* cover natural hair 1200 (i.e., preferably such that there are no leave-outs). If portions 1350 and 1360 are not thick enough to adequately cover the portions of natural hair 1200 that they are positioned over (i.e., to prevent leave outs), then thicker or additional hair extensions, similar to hair extension 1310, may be attached to braided row 1100 or other braided rows of the person's hair 1000 in the manner provided herein.

While not shown in the figures, an additional step may be performed to more secure the unwefted hair extension 1310 to braided row 1100 by obtaining a minority of the strands of portions 1350*b* and 1360*b* and tying them in another knot (e.g., a slip knot) with portion 1360*a*. Alternatively or additionally, unwefted hair extension 1310 may be more secured to braided row 1100 by tying portions 1350*a* and 1360*a* in an additional knot (e.g., a slip knot) against attachment point 1110 prior to positioning portions 1350*a* and 1360*a* over natural hair 1200. One or more of these additional steps may be helpful to secure relatively thinner, straighter, and/or silkier hair, including, for example, synthetic hair, that is prone to becoming loose.

The processes shown and described with reference to FIGS. 1A-1T and in the preceding paragraph may be repeated using hair extensions, such as hair extension 1310, at different attachment locations along braided row 1100 and along additional braided rows, similar to braided row 1100, until the weave is complete. This process advantageously attaches hair extensions to a person's natural hair without damaging the person's natural hair or scalp, in a secure manner that permits manipulation of the hair extensions without slipping in the same way a person would manipulate their natural hair, and such that the weave looks like the person's natural hair and no leave outs are visible. For example, the processes of attaching hair extensions described herein do not include using any adhesive, tape, heat, chemicals, clips, caps, wefts, or thread.

Additionally, hair extensions attached according to the methods described herein may be removed without damaging the person's natural hair or having to use professional assistance. To remove hair extensions attached according to the methods described herein, the hair extensions may first be cut (though they need not be) near (e.g., between about one inch and two inches above) the attachment points to the braided rows so that the knots are more visible and more easily accessed. Then, the braided rows may be undone (i.e., unbraided) by locating fasteners such as rubber bands, including, for example, colored rubber bands, that were used to secure the braided rows and removing them. For example, locating and removing the fasteners may be performed after the hair extensions are cut near the attachment points of the braided row. After a braid fastener is removed, that braided row can be unbraided and the hair extensions attached to that braided row may be slipped off during unbraiding. This method avoids having to pull on or cut the hair extensions, for example where they are knotted, which might unintentionally result in damage to the person's natural hair and/or scalp. The removal processes described may be performed for each braided row until the weave is entirely removed. Alternatively or additionally, the hair extensions may be removed by pulling on them (e.g., on the knots), or if needed, cutting them, to loosen and remove them from the braided rows.

The processes of attaching hair extensions described herein may create weaves of various styles, thicknesses, and lengths, depending on, for example, the type and number of unwefted hair extension(s) used. For example, FIG. 2A depicts an image of an unwefted hair extension 2300*a* having multiple strands 2310 and a midpoint 2340*a* approximately equidistant from a first end 2320*a* and a second end 2330*a* such that roughly equally sized portions 2350*a* and 2360*a* are formed. Hair extension 2300*a* may be used in the process of attaching a hair extension described above such that the first portion 2350*a* and second portion 2360*a* may both be positioned over the same side of the person's head (i.e., the same side of the braided row) to make the weave thicker in that location (i.e., have more volume). For example, the unwefted hair extension 2300*a* may have total length of about 24 inches between first end 2320*a* and second end 2330*a*, such that the length of the weave is about 12 inches long when attached in the manner just described.

Figure 2B:
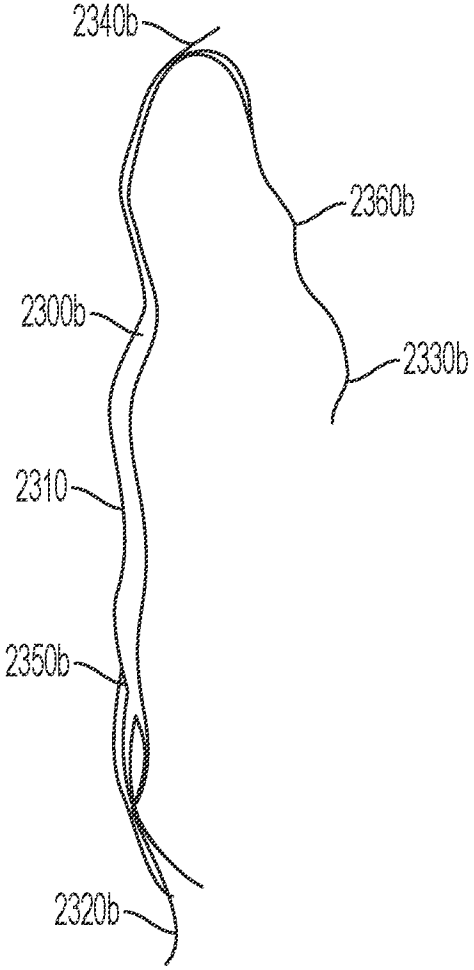
FIG. 2B is an image of an unwefted hair extension having a midpoint closer to one end of the unwefted hair extension than the other end according to some embodiments of the disclosure.
Figure 2A:
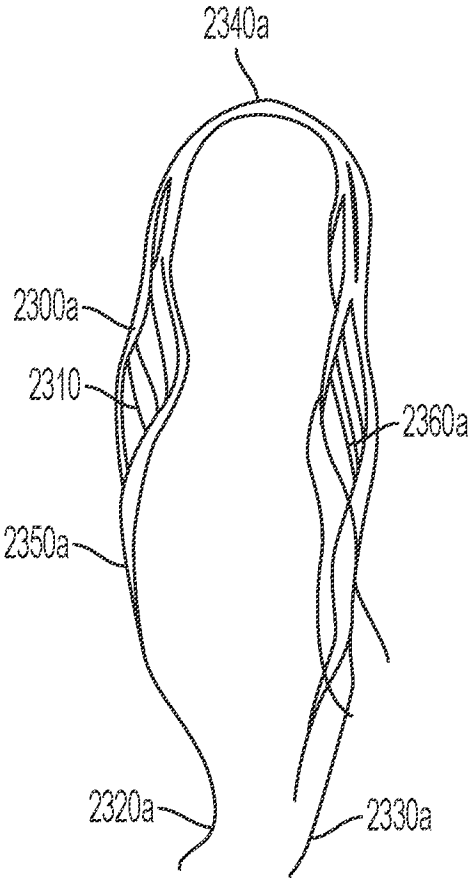
FIG. 2A is an image of an unwefted hair extension having a midpoint approximately equidistant from the ends of the unwefted hair extension according to some embodiments of the disclosure.

The same hair extension may be used differently, as shown in FIG. 2B, to create a longer and less thick weave. As shown in FIG. 2B, unwefted hair extension 2300*b* is identical to unwefted hair extension 2300*a*, except that its midpoint is selected differently. Hair extension 2300*b* has a midpoint 2340*b* that is closer to one end 2330*b* than to the other end 2320*b* of hair extension 2300*b* such that first portion 2350*b* is longer than second portion 2360*b*. Hair extension 2300*b* may be used in the process of attaching a hair extension described above such that, all else being equal, the weave is longer and thinner (i.e., less volume) at the location where the first portion 2350*b* and second portion 2360*b* are positioned than if hair extension 2300*a* was used at that location instead. For example, the unwefted hair extension 2300*b* may, like unwefted hair extensions 2300*a*, have a total length of about 24 inches between first end 2320*b* and second end 2330*b*, such that the length of the weave is about 16-18 inches long when attached in the manner just described, but only of a single thickness (as opposed to double thickness as described in reference to FIG. 2A) over most of that length (e.g., except for where it overlaps with the shorter portion that is about 4-6 inches long). This configuration provides layered fullness, with less volume and longer length than the configuration described with reference to hair extension 2300*a*.

In some embodiments, a weave may be created using the attachment methods described herein using only about 3.5-4 standard bundles of hair extensions, where each bundle weighs about 50 grams, for a total hair extension weight of about 200 grams or less. Such a weave is therefore lightweight and relatively inexpensive.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

braiding hair of a person into a row on the head of the person to form a braided row; and then, attaching an unwefted hair extension of multiple hair strands to the braided row, the hair extension having a first end, a second end, and a midpoint between the first end and the second end, where attaching the unwefted hair extension to the braided row comprises:

passing the midpoint under the braided row at a location that is between the braided row and the head of the person without passing the first end and the second end under the braided row, such that a first portion of the unwefted hair extension is formed between the location and the first end and a second portion of the unwefted hair extension is formed between the location and the second end;

rotating the midpoint axially about the location to create a loop in the unwefted hair extension;

passing the first end through the loop and tightening the loop against the braided row at the location to form a first knot; and securing the loop against the braided row at the location by tying a second knot adjacent to the loop with a minority of strands of the first portion and a minority of strands of the second portion.

2. The method of claim 1, wherein creating the loop includes axially rotating the midpoint about the location multiple times.

3. The method of claim 1, wherein the second knot is a slip knot.

4. The method of claim 1, further comprising wrapping the minority of strands of the first portion multiple times around the minority of strands of the second portion before securing the loop against the braided row.

5. The method of claim 1, further comprising positioning the strands of the first portion and the strands of the second portion such that they are covering the person's hair.

6. The method of claim 5, wherein the midpoint is equidistant from the first end and the second end and positioning the strands of the first portion and the strands of the second portion such that they are covering the person's hair comprises positioning the strands of the first portion and the strands of the second portion such that they are covering the person's hair on the same side of the braided row.

7. The method of claim 5, wherein the midpoint is closer to the first end than to the second end and the positioning the strands of the first portion and the strands of the second portion such that they are covering the person's hair comprises positioning the strands of the first portion and the strands of the second portion such that they are covering the person's hair on the same side of the braided row.

8. The method of claim 1, wherein the midpoint is equidistant from the first end and the second end.

9. The method of claim 1, wherein the midpoint is closer to the first end than to the second end.

10. The method claim 1, further comprising coupling the unwefted hair extension to a crochet tool and pulling the midpoint under the braided row using the crochet tool.

11. The method of claim 1, further comprising:

attaching a second unwefted hair extension of multiple hair strands to the braided row, the second hair extension having a first end, a second end, and a midpoint between the first end and the second end of the second unwefted hair extension, where attaching the second unwefted hair extension to the braided row comprises:

passing the midpoint of the second unwefted hair extension under the braided row at a second location that is between the braided row and the head of the person without passing the first end and the second end of the second unwefted hair extension under the braided row, such that a first portion of the second unwefted hair extension is formed between the second location and the first end of the second unwefted hair extension and a second portion of the second unwefted hair extension is formed between the second location and the second end of the second unwefted hair extension;

rotating the midpoint of the second unwefted hair extension axially about the second location to create a loop in the second unwefted hair extension;

passing the first end of the second unwefted hair extension through the loop of the second unwefted hair extension and tightening the loop of the second unwefted hair extension against the braided row at the second location to form a first knot in the second unwefted hair extension; and securing the loop of the second unwefted hair extension against the braided row at the second location by tying a second knot in the second unwefted hair extension adjacent to the loop of the second unwefted hair extension with a minority of strands of the first portion of the second unwefted hair extension and a minority of strands of the second portion of the second unwefted hair extension.

12. The method of claim 1, wherein attaching the unwefted hair extension to the braided row does not include using any adhesive, tape, heat, chemicals, clips, caps, wefts or thread.

13. The method of claim 1, further comprising securing the braided row using a fastener.

14. The method of claim 13, wherein the fastener is a colored rubber band.

15. The method of claim 1, further comprising removing the unwefted hair extension from the braided row without cutting the hair of the person or using chemicals.

16. The method of claim 15, further comprising cutting the unwefted hair extension near the location.

17. The method of claim 15, further comprising removing a fastener from the braided row, unbraiding the braided row, and removing the unwefted hair extension from the braided row.

* * * * *